US012419430B2

(12) United States Patent
Rosenberg

(10) Patent No.: US 12,419,430 B2
(45) Date of Patent: Sep. 23, 2025

(54) BED SYSTEM WITH MOVABLE MIDDLE PLATFORM

(71) Applicant: Malky Rosenberg, Monroe, NY (US)

(72) Inventor: Malky Rosenberg, Monroe, NY (US)

( * ) Notice: Subject to any disclaimer, the term of this patent is extended or adjusted under 35 U.S.C. 154(b) by 273 days.

(21) Appl. No.: 18/146,421

(22) Filed: Dec. 26, 2022

(65) Prior Publication Data

US 2024/0206630 A1 Jun. 27, 2024

(51) Int. Cl.
*A47C 19/02* (2006.01)

(52) U.S. Cl.
CPC ..... *A47C 19/021* (2013.01)

(58) Field of Classification Search
CPC ... A47C 19/021; A47C 19/045; A47C 20/041; A47C 19/04
USPC ..... 5/200.1
See application file for complete search history.

(56) References Cited

U.S. PATENT DOCUMENTS 373,445 A * 11/1887 Decker ..... A47C 17/16 5/38
544,630 A * 8/1895 Scherer ..... A47C 17/32 5/8
1,532,497 A * 4/1925 Jones ..... A61G 7/0518 5/722
2,471,977 A * 5/1949 Power ..... A47C 21/00 211/184
2,556,913 A * 6/1951 Gilbert ..... A47C 21/00 5/513
2,563,570 A * 8/1951 Williams ..... A47C 21/00 211/184
2,704,371 A * 3/1955 Liphart ..... A47C 19/027 5/513
3,248,742 A * 5/1966 Johnson ..... A47C 21/00 5/59.1
D360,775 S * 8/1995 Karkoska ..... D6/335
7,082,634 B1 * 8/2006 Hinds ..... A47C 21/00 5/513
8,850,638 B1 * 10/2014 Suh ..... A47C 19/022 5/311
9,182,750 B2 11/2015 Rawls-Meeham
D948,885 S 4/2022 Meneghello et al.
11,744,379 B1 * 9/2023 Patel ..... A47C 19/04 5/200.1
2021/0259431 A1 * 8/2021 Wang ..... A47C 31/008
2022/0125217 A1 * 4/2022 Connor ..... A47C 27/061

* cited by examiner

*Primary Examiner* — Amber R Anderson
*Assistant Examiner* — Luke Hall
(74) *Attorney, Agent, or Firm* — Michael J. Feigin, Esq.; Feigin and Fridman LLC

(57) ABSTRACT

A bed frame with two mattresses and a height-adjustable platform is described herein. The bed frame contains two separate areas for mattresses, with the platform placed there-between. The mattresses may be placed such that the mattresses do not touch each other, and such that one or both mattresses do not touch the movable platform. The bedframe may include a headboard. The platform may have a range of heights such that, at a lowest height thereof, its top level is substantially level with a top level of the bedframe and such that, at a highest height thereof, its top level is substantially higher than a top level of one or both of the mattresses.

12 Claims, 11 Drawing Sheets

BED SYSTEM WITH MOVABLE MIDDLE PLATFORM

FIELD OF THE DISCLOSED TECHNOLOGY

The disclosed technology relates to beds. More specifically, the disclosed technology relates to a device for temporarily separating two beds on a single bed frame.

BACKGROUND OF THE DISCLOSED TECHNOLOGY

Sleep eludes many individuals. For married couples, who spend years or decades sleeping next to each other, sleep may be especially difficult when one's partner tosses and turns or snores all night. Some bedmates may also find it difficult to sleep when their partners roll onto them or otherwise shake the bed while asleep.

Additionally, there are those for whom there exists a religious mandate for spouses to spend at least some time in separate beds. Beds which connect to each other, even if only on one side, may be considered a single bed according to, for example, Jewish law. Thus, it is desirable to be able to have a single bed between which a barrier may be placed, such that the single bed may be regarded as two separate beds and/or such that the movements and actions of a sleeper on one side of the barrier do not affect a sleeper on the other side, without requiring movement of beds or impeding the beds' use for sleeping.

SUMMARY OF THE DISCLOSED TECHNOLOGY

A bed system of embodiments of the disclosed technology has an exterior bed frame that has a left side, right side, front side, and back side. A height adjustable platform extends between the front side and the back side of the exterior bed frame substantially or fully, connectedly or disconnectedly, depending on embodiment. "Fully" is defined as "without space between". "Connectedly" and "attached" is defined as "physically attached". "Disconnectedly" and "unattached" are defined as "placed adjacent (within 6 inches) or touching and lacking physical attachment thereto but for, in some cases, friction".

A left bed can be placed on the left side of the height adjustable platform (herein, "platform"). A right bed can be placed on the right side of the platform. The left bed and right bed are unattached to each of the bed frame and the platform. The beds can further be spaced apart from each of the bed frame and platform on one or more sides ("spaced apart" being defined as "at least one inch"). The purpose of this spacing is to prevent movement, or feeling of movement, by someone on one bed when the movement is caused by someone on the other bed for reasons of undisturbed sleep and/or for religious reasons.

A headboard can be fixedly attached to the back side of the exterior bed frame, and a maximum height of the height adjustable platform can be limited to a height below a top of the headboard by a height altering mechanism or a height altering device to change the height of the platform (the terms "height altering mechanism" and "height altering device" being used interchangeably and synonymously). In this manner, the headboard can be used to stabilize or connect to the platform for further support of the platform. In other versions or configurations of the devices, the platform height can have a minimum height equal to a top side of the beds or top side of a mattresses placed on a top side of the bed(s). The platform can be connected to both the front and back side of the bed frame.

The beds can be disconnected from the bed frame. That is, the bed or beds can be placed within the bed frame while the bed frame is a separate and disconnected unit from the bed or beds. As such, the interior side of an entirety of the bed frame, a left side of the height adjustable platform, and a right side of a height adjustable platform have planar sides lacking indentations or protrusions in embodiments of the disclosed technology. The beds can then be placed against/adjacent to the bed frame or be spaced apart from the bed frame on two, three, or four sides. The platform can extend horizontally to cover the gaps between the beds in embodiments of the disclosed technology.

The bed frame can be designed to hold two twin mattresses, one on each side of the bed frame, i.e. on either side of the platform. Other sized mattresses/beds can be used in embodiments of the disclosed technology such as single, queen, king, regular, tall, and other sizes. The exterior bed frame can have a height level with a top side of each of the left bed, the right bed, and the height adjustable platform. The exterior bed frame can extend to the floor, reach just below a mattress, or reach to the upper edge of a mattress.

The platform can be adjusted in height via mechanical (crank) or electrical mechanisms with "stops" (device to prevent the change of height past a point of placement of said device) at lower and upper ranges of mobility of the platform. The lower range can be at a height of the bed frame at which the bed frame has a flat upper side (exclusive of a headboard which may be higher). The lower range can instead be a height of a mattress placed on one of the beds. The maximum height can be one foot, two feet, or three feet above one of the lower ranges.

Any device or step to a method described in this disclosure can comprise or consist of that which it is a part of, or the parts which make up the device or step. The term "and/or" is inclusive of the items which it joins linguistically and each item by itself. "Substantially" is defined as at least 95% of the term being described and/or "within a tolerance level known in the art and/or within 5% thereof. Any device or aspect of a device or method described herein can be read as "comprising" or "consisting" thereof.

DETAILED DESCRIPTION OF EMBODIMENTS OF THE DISCLOSED TECHNOLOGY

A bed frame with two mattresses and a height-adjustable platform is described herein. The bed frame contains two separate portals sized to fit a bed, with each bed having a mattress. The platform placed there-between. The respective beds and mattresses are placed such that the beds and mattresses do not touch each other or any part of the bed frame and movable platform. The platform, however, can be integrated into, and be a connected part of the bed frame or separately placed within a portal between the two separate portals for the beds.

The bedframe may include a headboard. The platform may have a range of heights such that, at a lowest height thereof, its top level is substantially level with a top level of the bedframe and such that, at a highest height thereof, its top level is substantially higher than a top level of one or both of the mattresses such as 6 inches, 12 inches, or 2 feet higher than a top level of the mattresses.

For purposes of this disclosure, "top" is defined as farthest upward along a vertical axis, where the vertical axis is substantially parallel to an axis along which the height-adjustable platform extends. "Bottom" is defined as farthest downward along a vertical axis, where the vertical axis is substantially parallel to an axis along which the height-adjustable platform extends. An "upward direction" is defined as a direction moving from legs of the bed frame to a bed and/or mattress placed thereon, and a "downward direction" is defined as an opposite direction relative to an upward direction.

Embodiments of the disclosed technology will become more clear in view of the following discussion of the figures.

Figure 1:
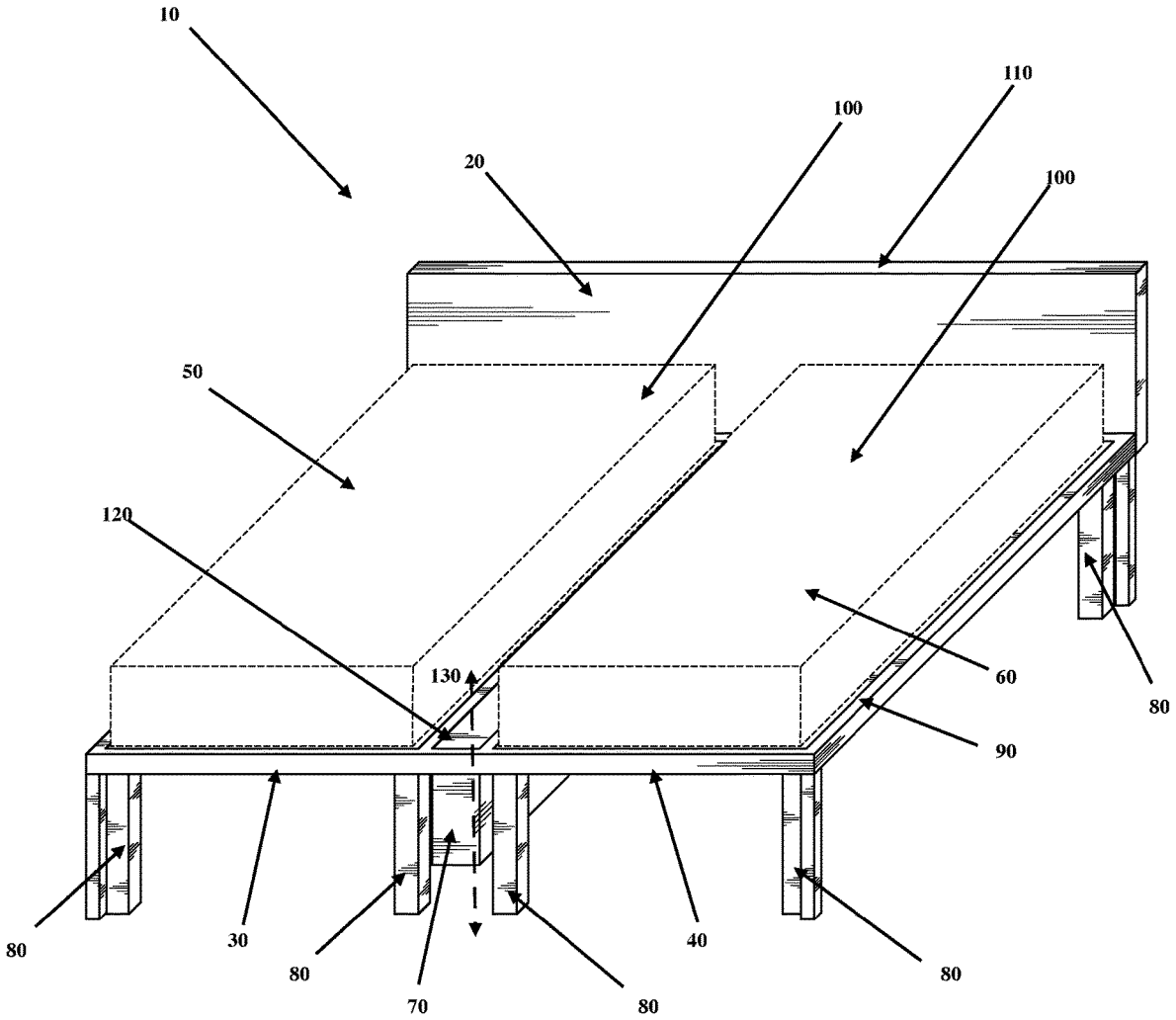
FIG. 1 shows a top and side perspective view of the bed system with the platform in lowered position in an embodiment of the disclosed technology.

FIG. 1 shows a top and side perspective view of the bed system with the platform in lowered position in an embodiment of the disclosed technology. The bed frame 10 has a headboard 20 attached at one end thereof. The bed frame 10 has a left side 30 and a right side 40, the sides divided by a moveable platform 70. A left bed 50, including a first mattress, is placed on the left side 30 of the bed frame 10, and a right bed 60, including a second mattress, is placed on the right side 40 of the bed frame 10. In the embodiment shown, each of the left side 30 and right side 40 of the bed frame 10 comprises a rectangular shape, and each contains four legs 80, each leg corresponding to a corner of the rectangular shape of its respective side.

"Mattress" is defined as a fabric case filled with deformable or resilient material, used for sleeping on. "Bed" is defined as a structure for sleep and/or rest.

The movable platform 70 is movable along a vertical axis 130 thereof. In the embodiment shown, the movable platform 70 is in a lowered position thereof. In the lowered position shown, a top level 120 of the platform 70 is substantially level with a top level 90 of the bed frame 10, and is lower in height than a top level 100 of both mattresses of both beds 50, 60 as well as a top level 110 of the headboard 20. In various embodiments, while the movable platform 70 is in a lowered position thereof, its top level 120 may be at a height lower than that of the top level 90 of the bed frame 10; a height between the top level 90 of the bed frame 10 and the top level 100 of both mattresses of both beds 50, 60; or a height substantially level with the top level 100 of one or both mattresses of both beds 50, 60. In some embodiments, the platform 70 is adjustable between some or all of these potential lowered positions. In other embodiments, the platform 70 is adjustable along the axis 130 to any height above its lowest height. In this manner, with the lowered platform 70, the mattresses of the left bed 50 and the right bed 60 can be pushed together forming a larger mattress based on the abutment of the two mattresses, such as when occupants of each bed desire to be next to each other.

In embodiments not shown in the figures, a removable insert may be insertable between the mattresses of both beds 50, 60 when the movable platform 70 is in a lowered position thereof. The insert may be padded, and may be shaped such that a top surface thereof is level with both top levels 100 of the mattresses of both beds 50, 60. In embodiments in which the top levels 100 of the mattresses of both beds 50, 60 are not of equal heights, the insert may be shaped such that its surface is substantially flat, with a left side thereof being equal in height to the height of the top side 100 of the mattress of the left bed 50 and a right side thereof being equal in height to the height of the top side 100 of the mattress of the right bed 60. In some embodiments in which the lowest height of the movable platform 70 is a height substantially equal to the height of top levels 100 of the mattresses of both beds 50, 60, the top side 120 of the movable platform 70 may be padded.

Figure 2:
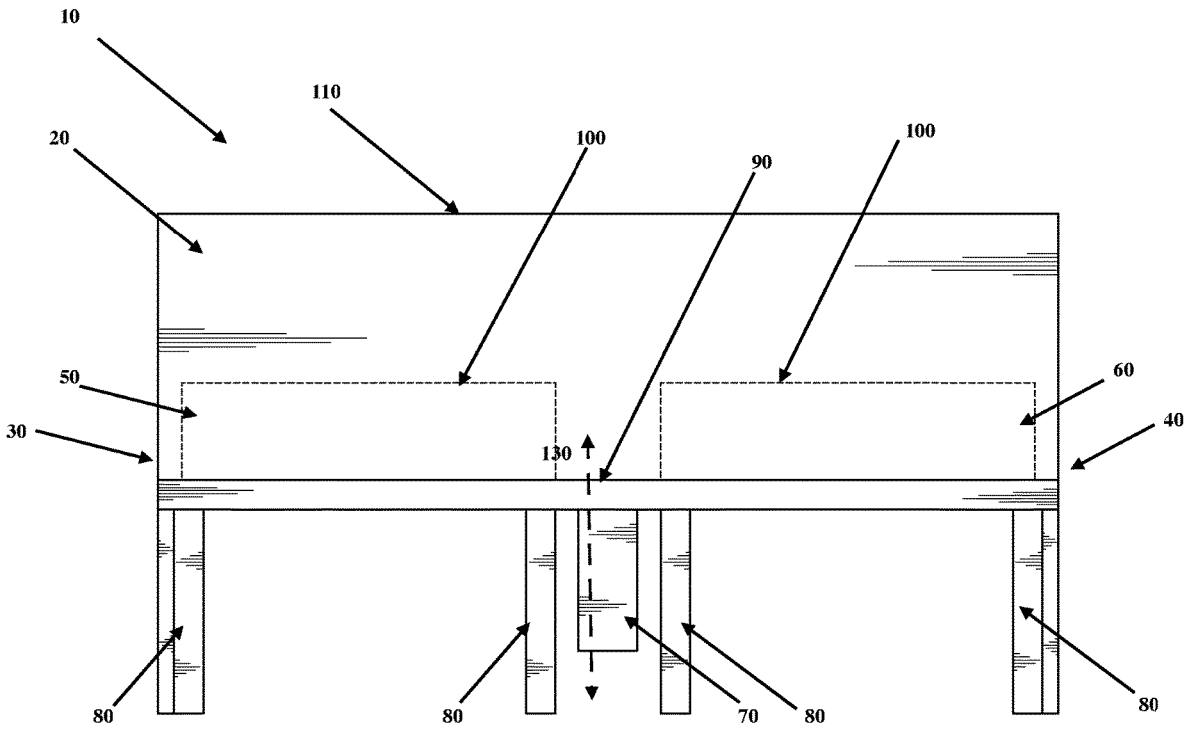
FIG. 2 shows a front elevation view of the bed system of FIG. 1.
Figure 3:
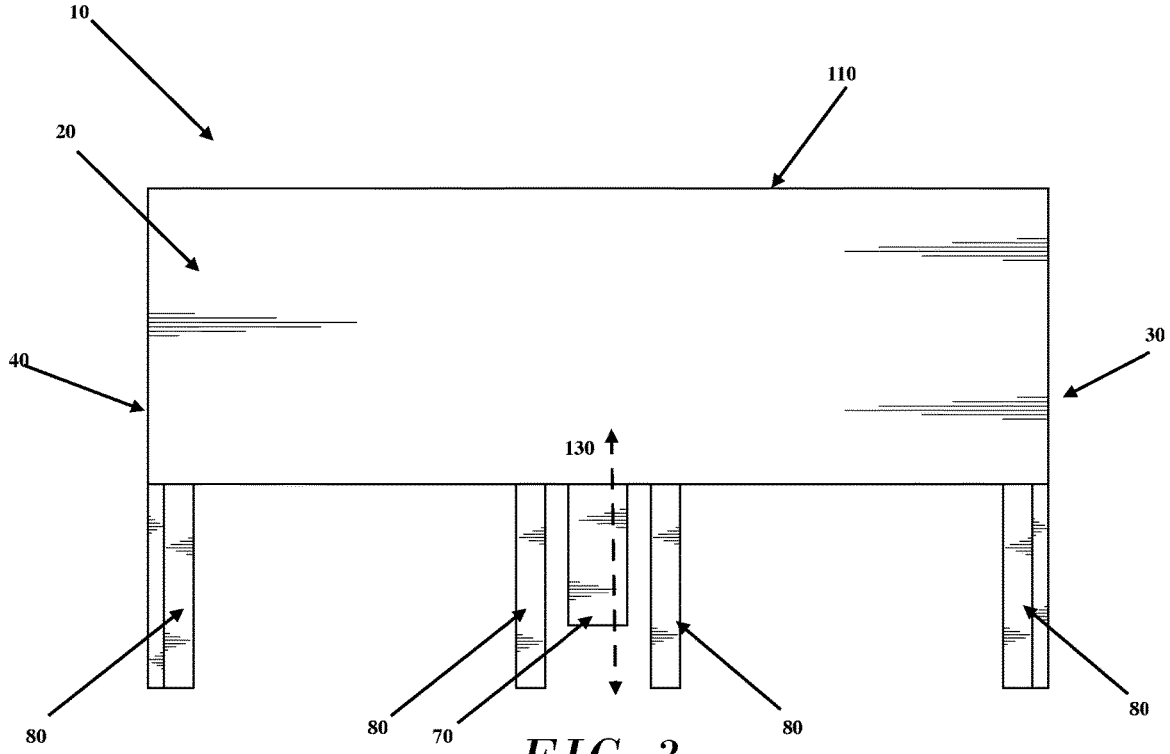
FIG. 3 shows a back elevation view of the bed system of FIG. 1.

FIG. 2 shows a front elevation view of the bed system of FIG. 1. FIG. 3 shows a back elevation view of the bed system of FIG. 1. In the embodiment shown, both the left bed 50's mattress and the right bed 60's mattress are adjacent to and spaced apart from the movable platform 70. In various embodiments, the left bed 50's mattress and/or the right bed 60's mattress are spaced apart from the platform 70 when the platform 70 is in its lowered position, including in embodiments in which the height of a top level 120 of the platform, 70, when in a lowered position, is higher than the height of the top level 90 of the bed frame 10. In such embodiments, the removable insert may comprise one or more inserts which may be removably inserted into a gap between sides of the mattresses of the beds 50, 60 and sides of the platform 70, such that a substantially level and continuous plane exists which includes the top level 120 of the platform 70 and the top levels 100 of the mattresses of both beds 50, 60.

In various embodiments, the beds 50, 60, and/or the mattresses thereof, are spaced apart at sides thereof from the bed frame 10, the headboard 20, and/or the platform 70 and sides thereof. Each of a distance between a side of the bed 50, 60 and/or the mattress thereof and the bed frame 10, the headboard 20, and/or the platform 70 may be ¼ inch, ½ inch, 1 inch, or any other distance.

In the embodiment shown, each of the left side 30 and the right side 40 of the bed frame 10 includes at least one outer leg 80 and at least one inner leg 80, where "outer" is defined as being farther from the platform 70 and "inner" is defined as being closer to the platform 70. In the embodiment shown, all internal legs are spaced apart from the platform 70 while the platform 70 is in a lowered position. In various embodiments, the internal legs 80 may be at any distance from the platform 70, or may be in contact on one side thereof with the platform 70 while the platform 70 is in its lower position, so long as movement of the platform 70 along the axis 130 is not impeded by friction due to the contact.

Figure 4:
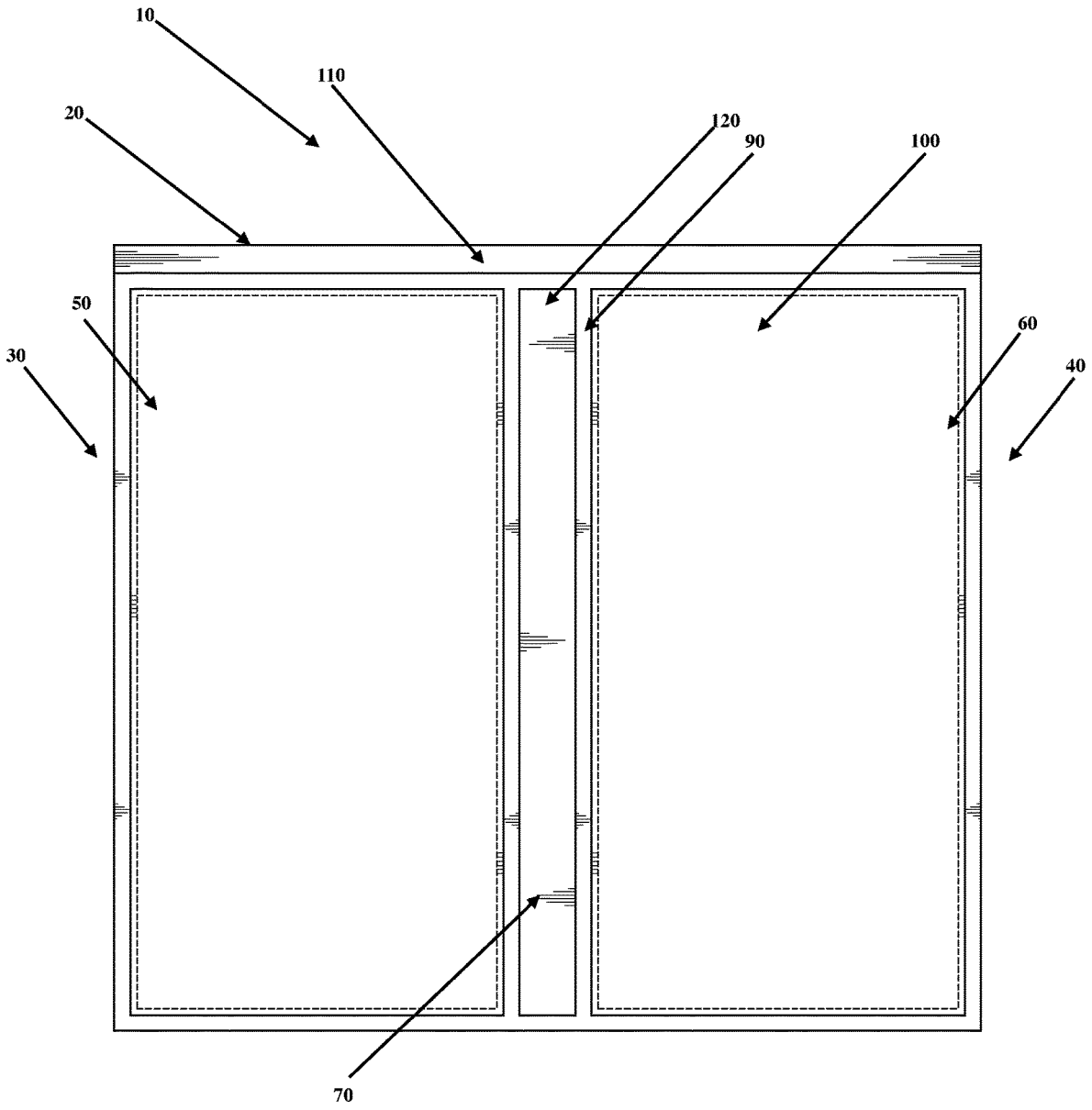
FIG. 4 shows a top plan view of the bed system of FIG. 1.
Figure 5:
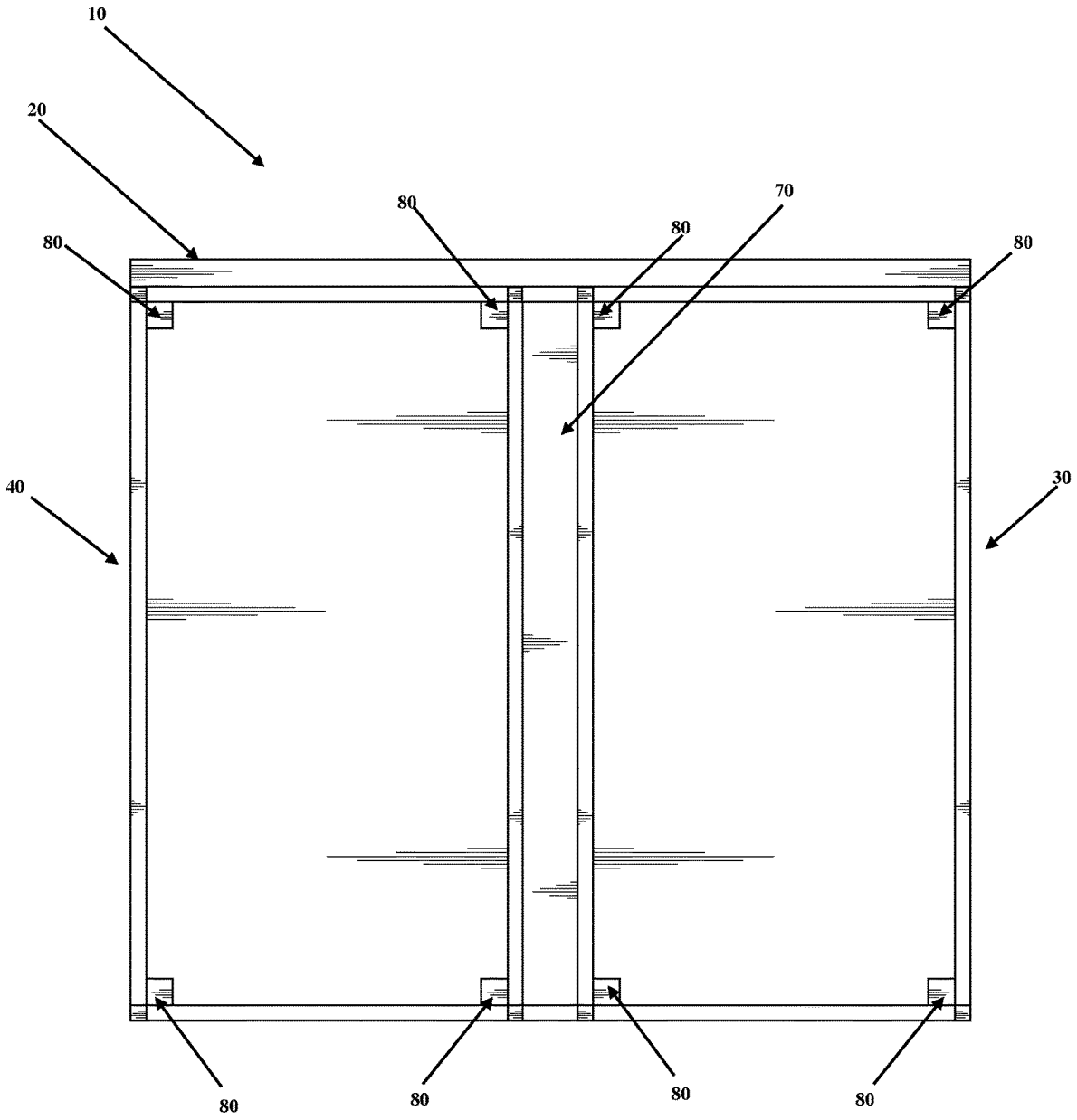
FIG. 5 shows a bottom plan view of the bed system of FIG. 1.

FIG. 4 shows a top plan view of the bed system of FIG. 1. FIG. 5 shows a bottom plan view of the bed system of FIG. 1. In the embodiment shown, a length of the movable platform 70 from a side thereof closest to the headboard 20 to an opposite side thereof is substantially equal to a length of one or both of the mattresses of the beds 50, 60 from a side thereof closest to the headboard 20 to an opposite side thereof. In other embodiments, the length of the movable platform 70 from the side thereof closest to the headboard 20 to the opposite side thereof may be greater than the length of one or both of the mattresses of the beds 50, 60 from the side thereof closest to the headboard 20 to the opposite side thereof.

In the embodiment shown, the headboard 20 is spaced apart from the side of the platform 70 closest thereto, and is also spaced apart from sides of each of the mattresses of the beds 50, 60 closest thereto. In some embodiments the headboard 20 is removably attachable to the bed frame 10. The headboard 20 may be any distance from the sides of the mattresses of the beds 50, 60 and the platform 70 closest thereto, so long as vertical movement of the platform 70 along the axis 130 is not impeded by friction due to the contact. Furthermore, the headboard 20 may comprise one or more separate and removable individual components.

The legs 80, in the embodiment shown, are placed internally relative to the sides of the bed frame 10. In embodiments, the legs 80 may simultaneously form sides of the bed frame 10, rather than being entirely internal relative thereto.

Figure 6:
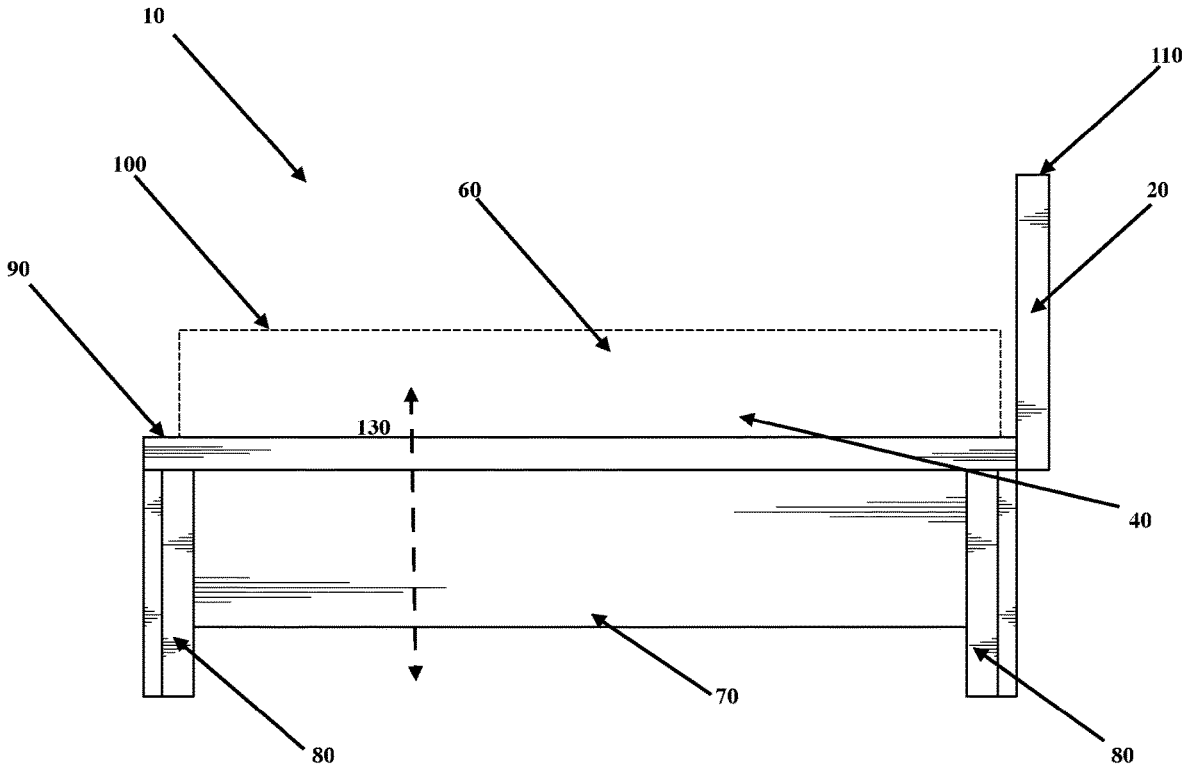
FIG. 6 shows a right side elevation view of the bed system of FIG. 1.

FIG. 6 shows a right side elevation view of the bed system of FIG. 1. In the embodiment shown, the platform 70 has a vertical height which is less than a vertical height from the top level 90 of the bed frame 10 to a surface on which the legs 80 are placed. In some embodiments, the platform 70 has a vertical height which is equal to the vertical height from the top level 90 of the bed frame 10 to the surface on which the legs 80 are placed. The platform 70 may bend, fold, or otherwise contract while moving vertically along the axis 130 into its lowered position, such that the vertical height of the platform 70 in its lowered position is smaller than its vertical height in a raised position thereof.

Figure 7:
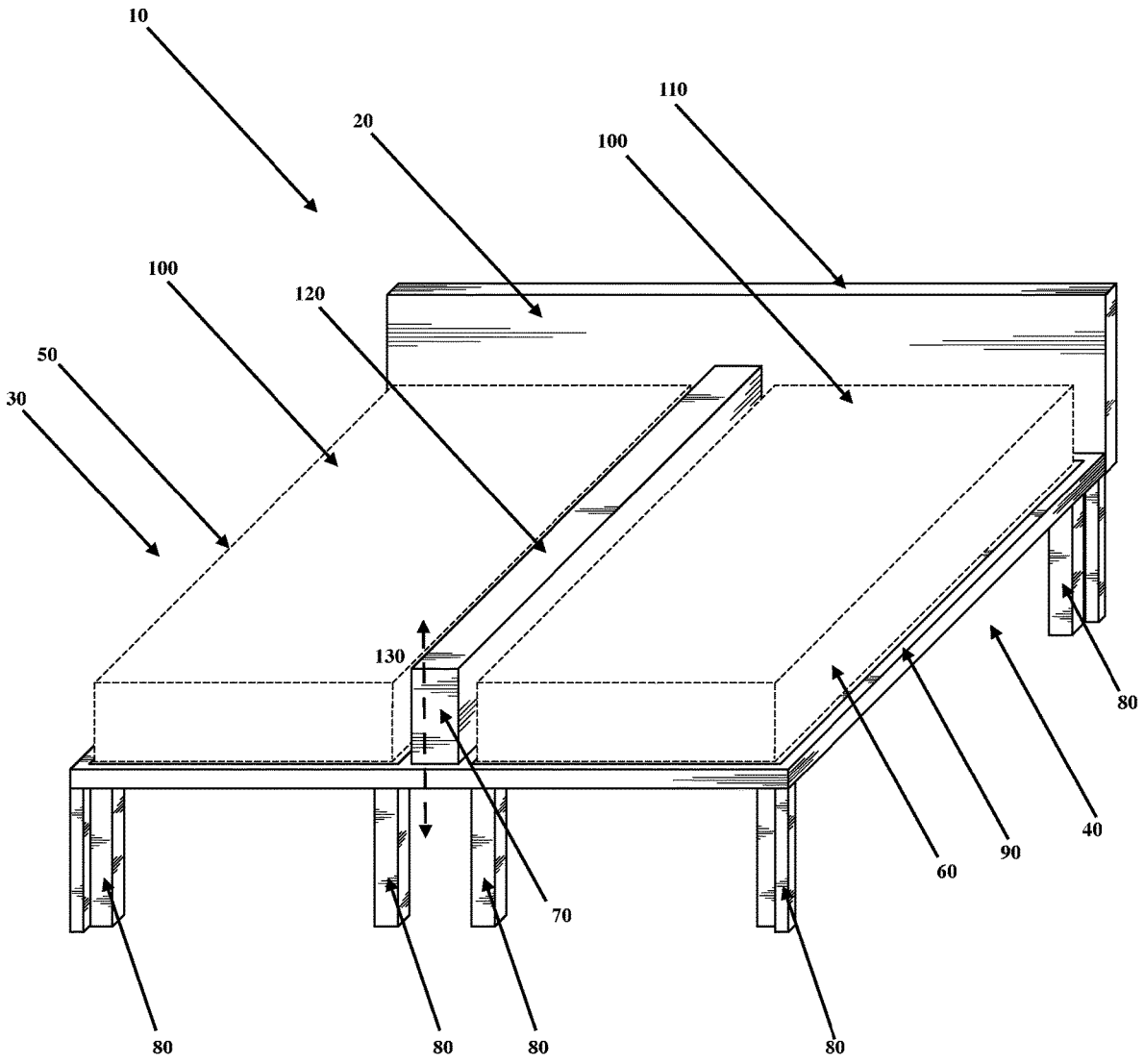
FIG. 7 shows a top and side perspective view of the bed system of FIG. 1 with the platform in raised position thereof in another embodiment of the disclosed technology.

FIG. 7 shows a top and side perspective view of the bed system of FIG. 1 with the platform in raised position thereof in another embodiment of the disclosed technology. In the embodiment shown, the vertical height of the top level 120 of the platform 70 is above that of the top level 100 of both of the mattresses of the beds 50, 60, and is lower than that of the top level 110 of the headboard 20. In embodiments, the vertical height of the top level 120 of the platform 70 is substantially equal to or higher than that of the top level 110 of the headboard 20.

In some embodiments, the platform 70 is vertically movable along the axis 130 into a single pre-fixed raised position and a single pre-fixed lowered position. The term "pre-fixed" is defined as "chosen and established during design of the present invention" or as "chosen and established once or more by users of the present invention." In other embodiments, the platform 70 is vertically movable along the axis 130 into one or more pre-fixed raised positions and one or more pre-fixed lowered positions. In further embodiments, the platform 70 is positionable at any position vertically between a pre-fixed lower-most vertical bound and a pre-fixed upper-most vertical bound.

Figure 8:
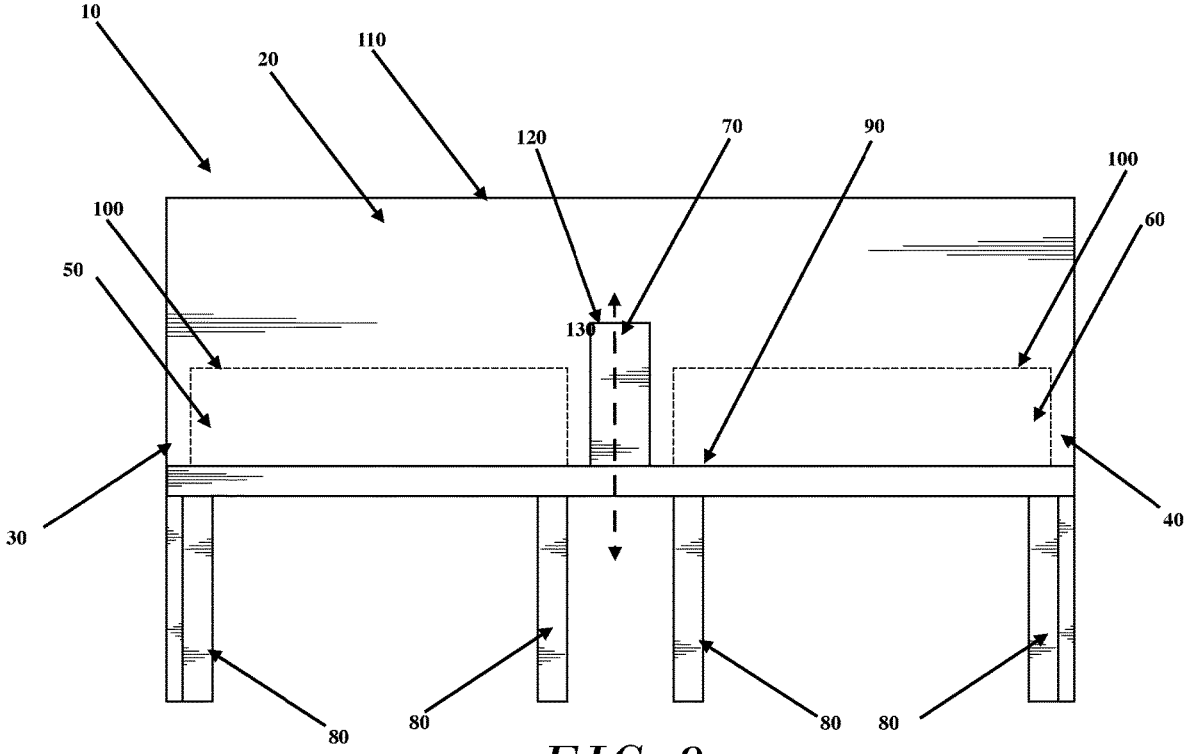
FIG. 8 shows a front elevation view of the bed system of FIG. 7.
Figure 9:
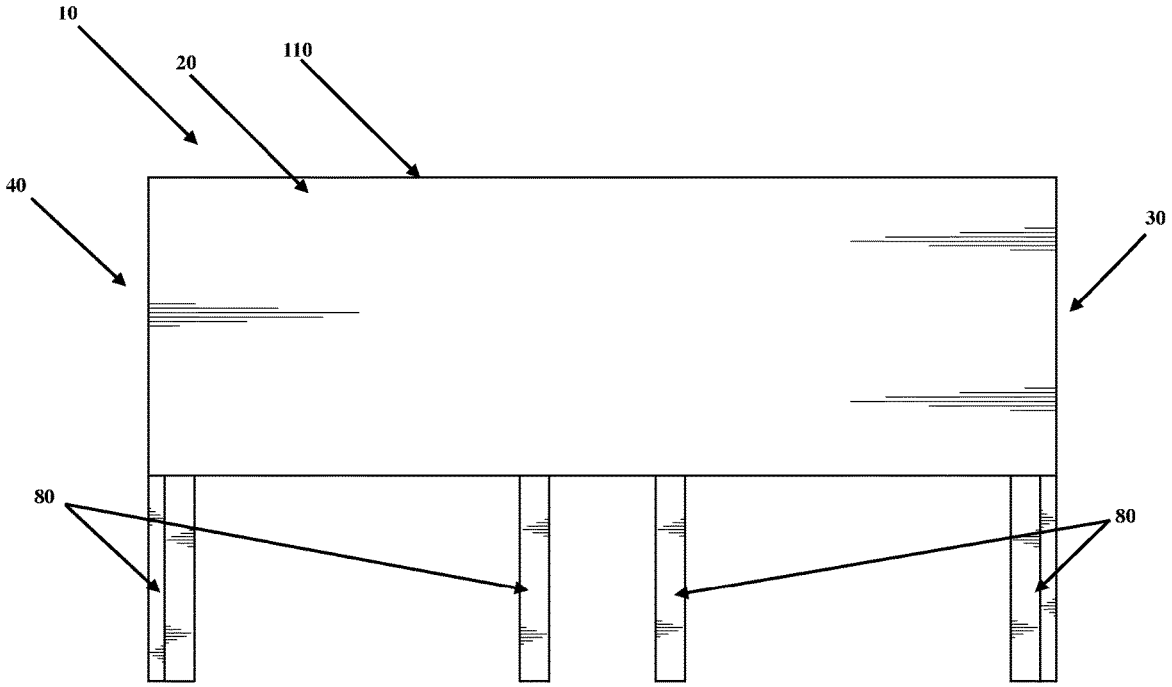
FIG. 9 shows a back elevation view of the bed system of FIG. 7.

FIG. 8 shows a front elevation view of the bed system of FIG. 7. FIG. 9 shows a back elevation view of the bed system of FIG. 7. In some embodiments, the movable platform 70 comprises two separate spaced-apart movable platforms 70. The two movable platforms 70 may be substantially identical in shape and size, and may be configured such that top levels 120 of each platform 70 are substantially always at a same vertical height. The platform 70 may include padding along at least one side which is closest to the mattresses of the beds 50 and 60.

Figure 10:
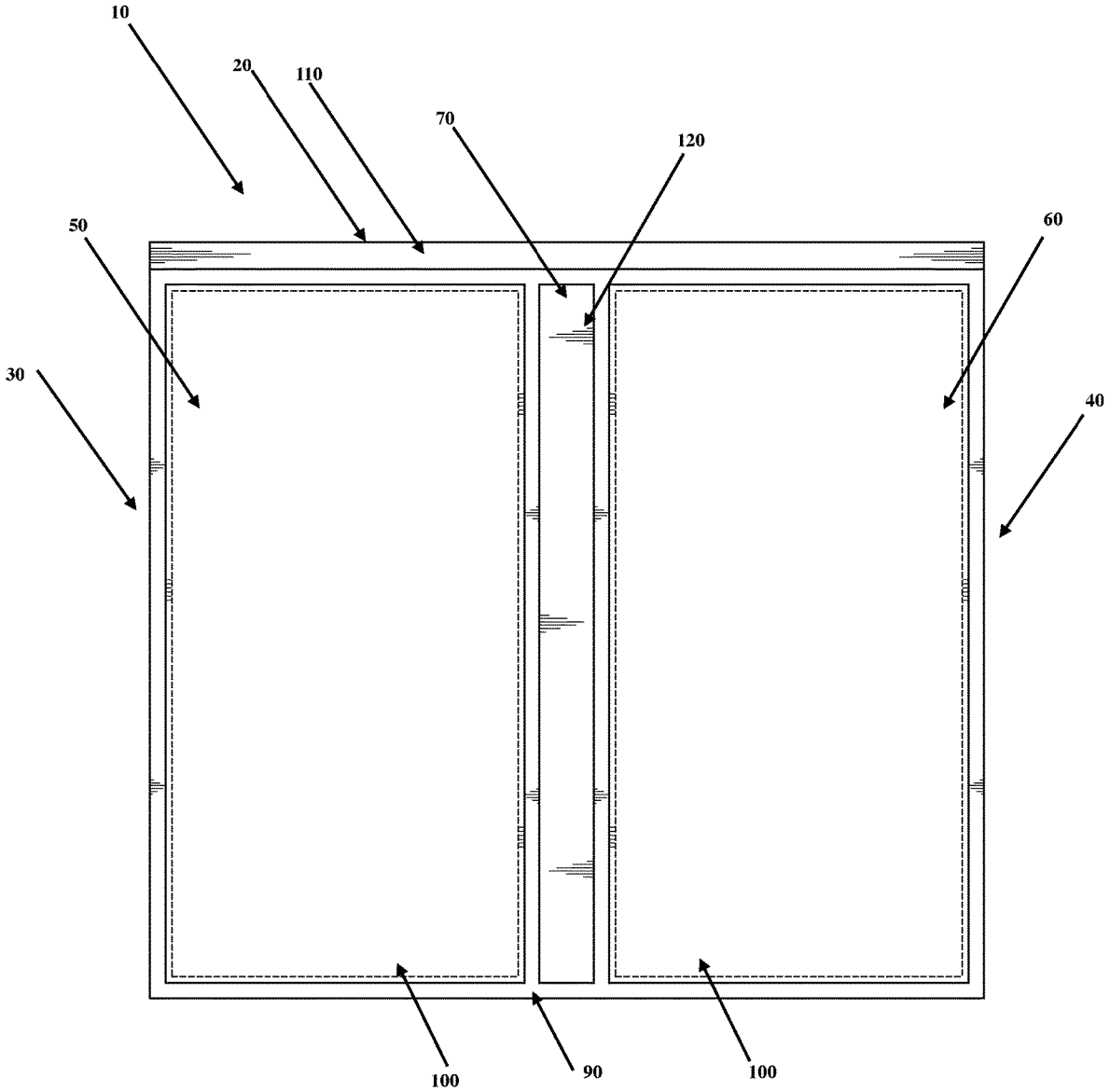
FIG. 10 shows a top plan view of the bed system of FIG. 7.
Figure 11:
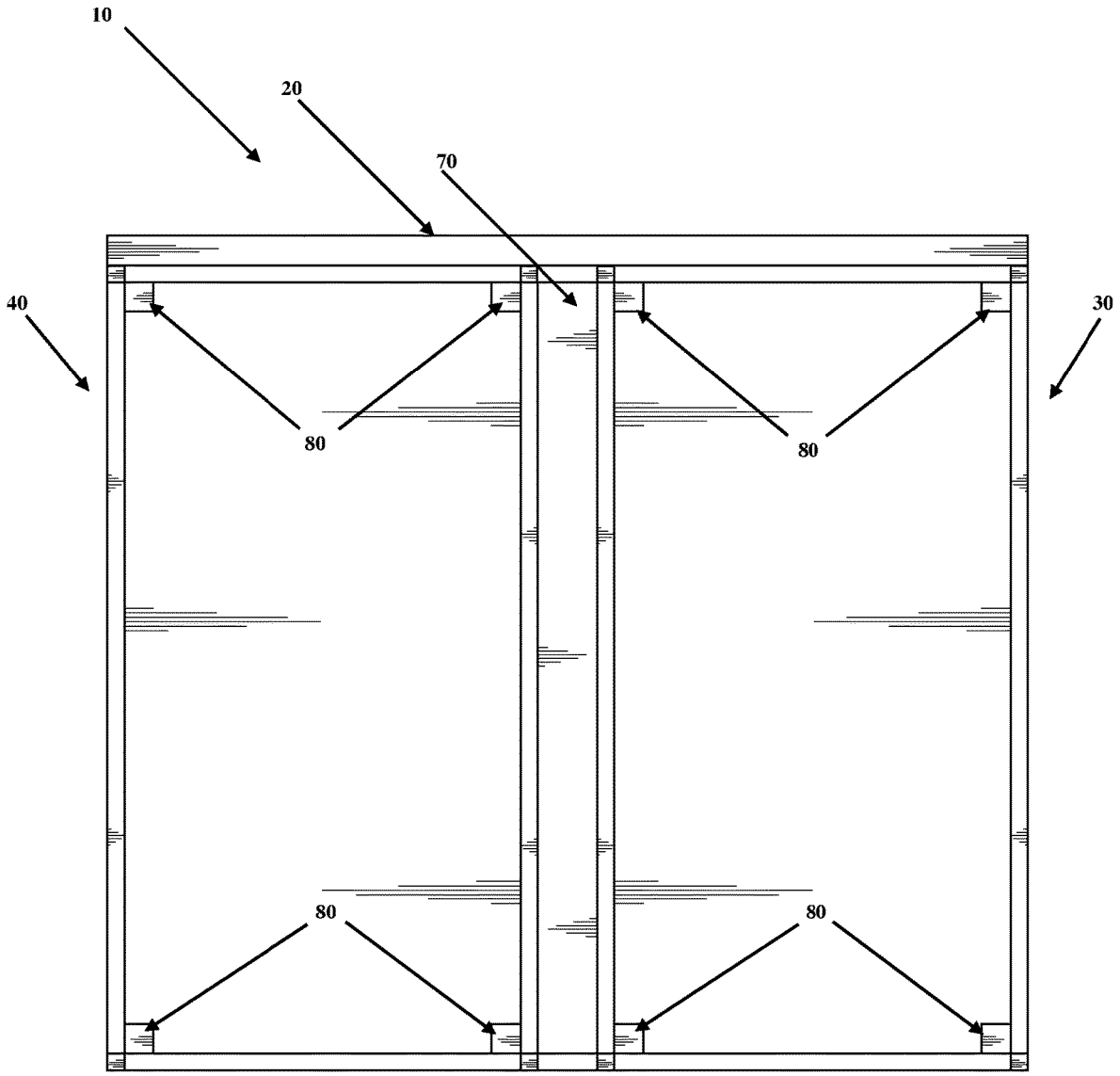
FIG. 11 shows a bottom plan view of the bed system of FIG. 7.
Figure 12:
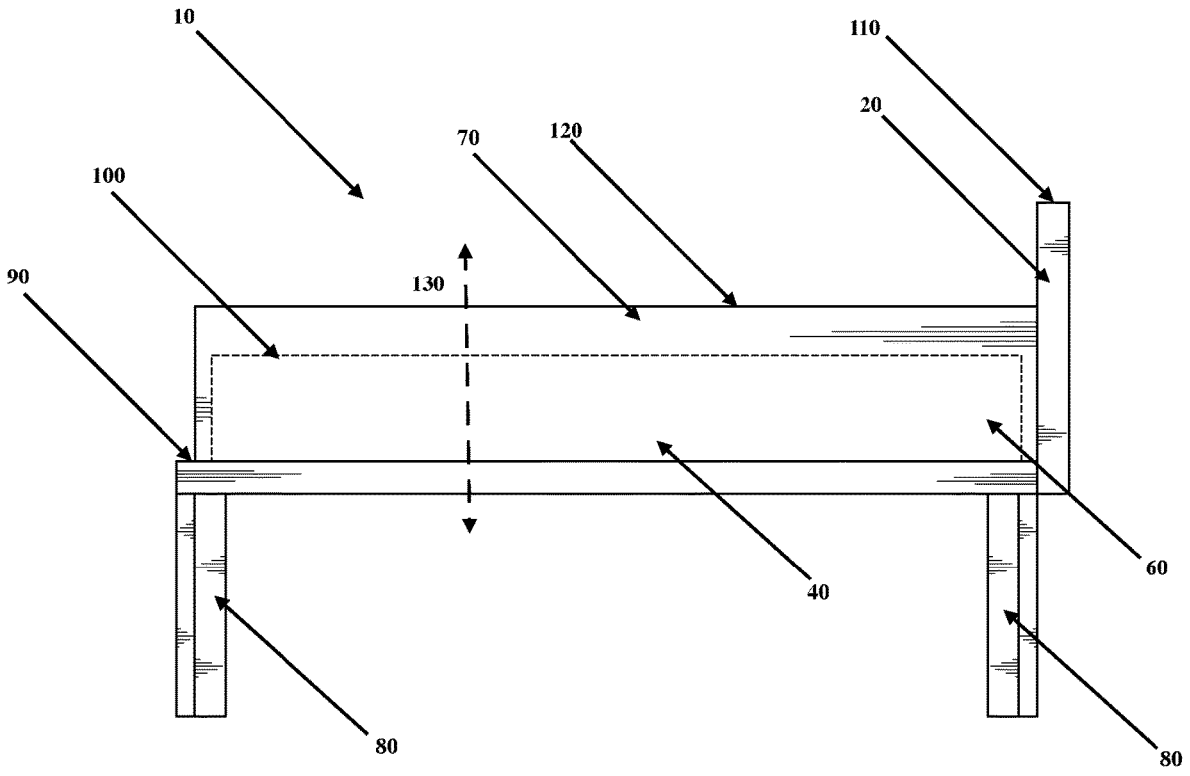
FIG. 12 shows a right side elevation view of the bed system of FIG. 7.

FIG. 10 shows a top plan view of the bed system of FIG. 7. FIG. 11 shows a bottom plan view of the bed system of FIG. 7. FIG. 12 shows a right side elevation view of the bed system of FIG. 7. In various embodiments, the movable platform 70 is movable in a vertical direction along the axis 130 by way of electrical methods, such as actuators, and its vertical position may be adjusted by way of a button, an attached or separate remote, a selection from an attached or separate touchscreen, or other such mechanisms. In other embodiments, the movable platform is movable in the vertical direction along the axis 130 by way of mechanical methods, such as a pulley or lever, and its vertical position may be adjusted by way of a crank, a lever, or other such mechanisms. In further embodiments, the movable platform is movable in the vertical direction along the axis 130 by way of manual methods, such as by manually moving the movable platform 70 between supports at various heights.

Figure 13:
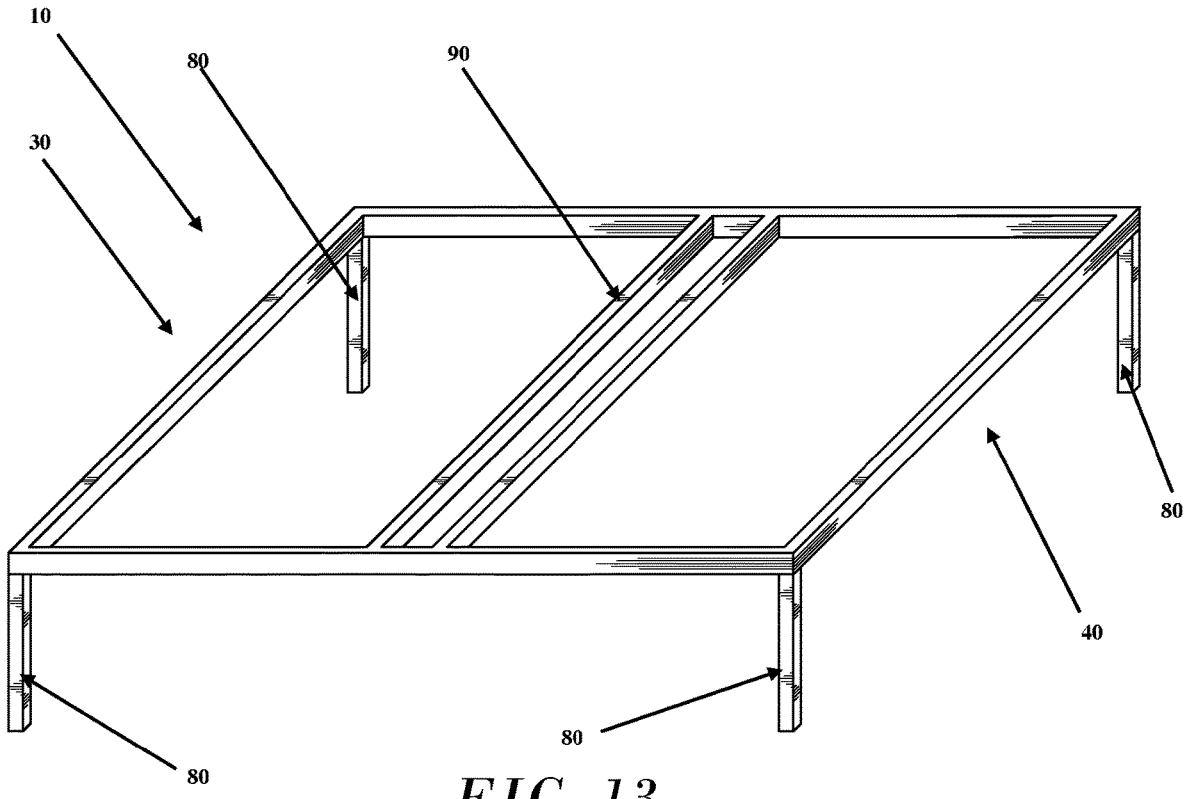
FIG. 13 shows a top and side perspective of a bed frame of the bed system in a further embodiment of the disclosed technology.
Figure 14:
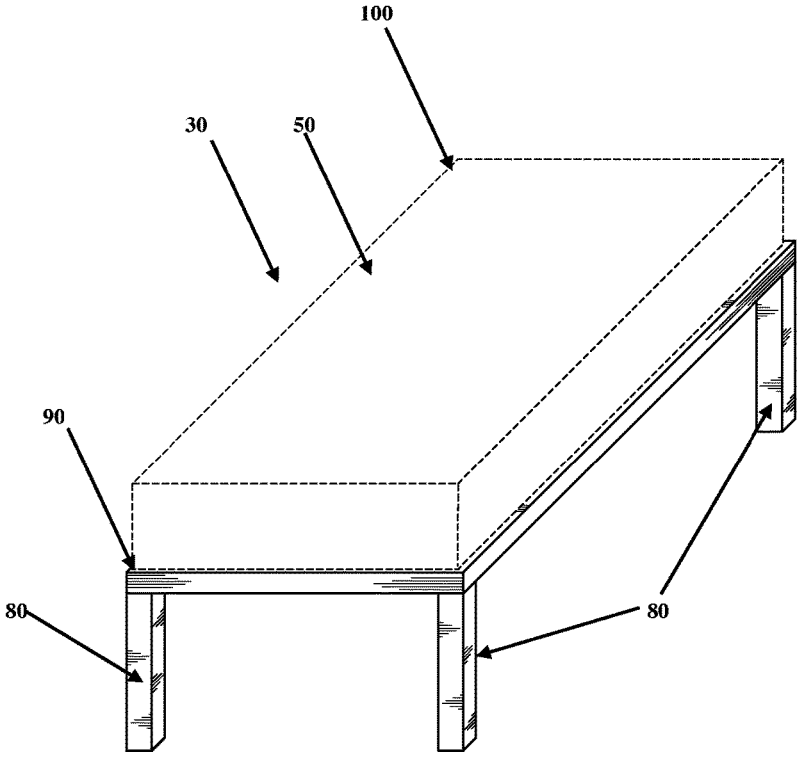
FIG. 14 shows a top and side perspective of a right side of the bed system in a further embodiment of the disclosed technology.

FIG. 13 shows a top and side perspective of a bed frame of the bed system in a further embodiment of the disclosed technology. FIG. 14 shows a top and side perspective of a right side of the bed system in a further embodiment of the disclosed technology. In various embodiments, the bedframe 10 may have four legs 80, one at each external corner of the bed frame 10; or may have eight legs 80, one at each corner of each of the left side, 30 and the right side 40 of the bed frame 10; or may have any other number and/or positioning and/or arrangement of legs 80 as is necessary to support the weight of the bed frame 10, the left bed 50's mattress, the right bed 60's mattress, the movable platform 70, and the headboard 20. In various embodiments, one or more of the legs 80 may be removable. In embodiments, the movable platform 70 may act as a support for the bed frame 10 when in the lowered position.

In the embodiment shown, the mattresses of the beds 50, 60 are placed on their respective sides, 30, 40 such that they are spaced apart at each side from edges of the bed frame 10. In other embodiments, the sides of the bed frame 10 may be arranged and or spaced such that one or more sides 30, 40 of the mattresses of the beds 50, 60 are flush therewith when placed thereon.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A multi-bed frame bed system comprising:

a first bed frame, said first bed frame further comprising:

a) three portals, said three portals being two identical rectangular portals and a third smaller rectangular portal between said two identical portals; and b) four legs, each leg at each corner of said first bed frame;

a second bed frame and a third bed frame, said second and third bed frames being substantially identical to each other, and each said second and third bed frame comprising:

c) a rectangular frame substantially equal in length and width to that of each of said two identical rectangular portals of said first bed frame;

d) four legs, each leg at a corner of said second bed frame or said third frame; and wherein each of said first bed frame, said second bed frame, and said third bed frame, lack physical attachment to each other; and wherein all said legs are of equal length.

2. The system of claim 1, wherein said second bed frame is placed within a first of said two identical rectangular portals of said first bed frame; and said third bed frame is placed within a second of said two identical rectangular portals of said first bed frame.

3. The system of claim 2, wherein:

said four legs of said first bed frame are only connected to and only support said first bed frame;

said four legs of said second bed frame are connected to and only support said second bed frame;

said four legs of said third bed frame are connect to and only support said third bed frame.

4. The system of claim 3, wherein a height adjustable platform passes through said third smaller rectangular portal.

5. The system of claim 4, wherein said height adjustable platform is movable only along a vertical axis, said vertical axis being parallel to a longest linear length of each leg of said four legs of each of said first, second, and third bed frames.

6. The system of claim 5, wherein a lowest position of said height adjustable platform is limited such that a top side of said height adjustable platform is parallel and flush to a top side of each of said first, second, and third bed frames, wherein said top side is a side of said first, second, and third bed frames opposite a side where the respective said legs are attached to respective said first, second, and third bed frames.

7. The system of claim 4, wherein said first bed frame, said second bed frame, and said third bed frame are completely disconnected from one another along vertical axes thereof.

8. The system of claim 1, wherein said first bed frame comprises four parallel rods in a first direction, each fixedly connected at opposing ends to two parallel rods, said two parallel rods perpendicular to said four parallel rods, thereby defining said three portals.

9. The system of claim 1, wherein a longest linear width of said second and said third frame is smaller than width of said first and second portal.

10. The system of claim 1, wherein length of said second and said thing frame is smaller than length of said first and second portal.

11. The system of claim 1, wherein a headboard extends from said first frame.

12. The system of claim 1, wherein a top of said first frame, a top of said second frame, and a top of said third frame are coplanar when said second and third frames are within said portal.

* * * * *